US005518246A

United States Patent [19]

Moriyama et al.

[11] Patent Number: 5,518,246

[45] Date of Patent: May 21, 1996

[54] GOLF BALL

[75] Inventors: Keiji Moriyama; Seiichiro Endo, both of Akashi; Mikio Yamada, Kobe, all of Japan

[73] Assignee: Sumitomo Rubber Industries, Ltd., Kobe, Japan

[21] Appl. No.: 348,993

[22] Filed: Nov. 29, 1994

[30] Foreign Application Priority Data

Dec. 7, 1993 [JP] Japan ..... 5-306871

[51] Int. Cl.[6] ..... A63B 37/14

[52] U.S. Cl. ..... 473/384

[58] Field of Search ..... 273/232, 220; 40/327

[56] References Cited

U.S. PATENT DOCUMENTS

| | | | |
|---|---|---|---|
| 4,813,677 | 3/1989 | Oka et al. | 273/232 |
| 5,259,624 | 11/1993 | Puckett | 273/232 |

FOREIGN PATENT DOCUMENTS

| | | |
|---|---|---|
| 62-79072 | 4/1987 | Japan . |
| 62-192181 | 8/1987 | Japan . |
| 4-150875 | 5/1992 | Japan . |
| 5-84328 | 4/1993 | Japan . |

*Primary Examiner*—George J. Marlo
*Attorney, Agent, or Firm*—Birch, Stewart, Kolasch & Birch

[57] ABSTRACT

In a golf ball according to the present invention, dimples formed on the surface thereof have the same diameter and are classified into first group dimples and second group dimples, and optionally different kinds of dimples within each group, the dimples of one kind differing in depth from the dimples of another kind within that group, each of the first group dimples having a depth substantially the same which is greater than the depth of each of the second group dimples which is also substantially the same for all the second group dimples. The depth of the first group dimple is from 130% to 280% of that of the second group dimple. Further, the number of the first group dimples is from 20% to 80% of the total number of the dimples.

6 Claims, 9 Drawing Sheets

GOLF BALL

BACKGROUND OF THE INVENTION

1. Field of the Invention

The present invention relates to a golf ball and more particularly to a golf ball having dimples of improved configurations formed on the surface thereof to make air in the periphery thereof turbulent during the flight thereof, so as to increase the flight distance thereof with a favorable aerodynamic symmetrical property maintained even though one great circle path unintersecting with dimples is formed on a seam line.

2. Description of the Prior Art

Normally, the golf ball has 280 to 540 dimples formed on the surface thereof. The role of the dimple is to reduce pressure resistance by shifting a separation point backward and improve lift by accelerating the difference between the above separation point and below the separation point. That is, in order to shift the separation point backward, it is necessary to make the flow of air in the periphery of the golf ball turbulent during the flight thereof to accelerate the transition of the turbulent flow of a boundary-layer and thereby cause the separation of the turbulent flow. Thus, it can be said that the dimple capable of making air in the periphery of the golf ball turbulent is aerodynamically superior.

In view of the role of the dimple, there are proposals of dimples, of the golf ball, having a function of making air in the periphery of the golf ball turbulent during the flight thereof. For example, the following golf balls were disclosed in Japanese Laid-Open Patent Publications: (1) a golf ball having large and small diameter dimples arranged thereon (Japanese Laid-Open Patent Publication No. 62-79072); (2) a golf ball having a plurality of kinds of dimples densely arranged thereon (Japanese Laid-Open Patent Publication No. 62-192181); (3) a golf ball having circular and uncircular dimples arranged thereon in combination with each other (Japanese Laid-Open Patent Publication No. 5-84328).

If a plurality of great circle paths unintersecting with dimples is formed on the surface of the golf ball, the area of a land, namely, the area of a region on which dimples are not formed, increases. As a result, the dimples are incapable of effectively making air flows turbulent. Thus, the present applicant proposed (disclosed in Japanese Laid-Open Patent Publication No. 04-150875) a dimple arrangement. According to the dimple arrangement, dimples formed in an orderly manner in divided regions formed by geometrically projecting a regular polyhedron on a spherical surface is varied such that great circle paths are not present on the surface of the golf ball except a great circle on a seam line, and dimples disposed on the seam line formed on a connecting surface of upper and lower mold are moved vertically or removed such that one great circle path is present on only the seam line.

When dimples with large and small diameter or dimples having circular and uncircular configurations are arranged on the surface of the golf ball densely and irregularly in combination with each other, such that one great circle path is present only on the seam line, air in the periphery of the golf ball can be made to be turbulent during the flight thereof and thus the flight distance thereof can be increased.

The golf ball having the above construction is, however, insufficient for maintaining a favorable aerodynamic symmetrical property because the great circle path unintersecting with dimples is present on the seam line. That is, the flight distances of the golf ball are different from each other depending on a hitting point thereof.

That is, the presence of a great circle path (S), unintersecting with dimples, formed on the seam line causes the flight distance of the golf ball in seam hitting to be different from the flight distance thereof in pole hitting. Seam hitting means a way of hitting a golf ball 1 such that a line connecting both poles (P) thereof serves as a rotational axis L1 in the back spin thereof, whereas pole hitting means a way of hitting the golf ball 1 such that a line perpendicular to the rotational axis L1 serves as a rotational axis L2 in the back spin thereof.

The golf ball causing the flight distances to be different from each other depending on a rotational axis is not recognized officially because the flight distances thereof are nonuniform.

It is important for the golf ball to have a favorable aerodynamic symmetrical property so that the difference between the flight distance thereof in seam hitting and the flight distance thereof in pole hitting is much less than the officially recognized standard distance.

SUMMARY OF THE INVENTION

The present invention has been developed with a view to substantially solving the above described disadvantages and has for its essential object to provide an improved golf ball having a superior aerodynamic symmetrical property and a constant trajectory such that the difference between the flight distance thereof in seam hitting and the flight distance thereof in pole hitting is less than the officially recognized standard distance.

It is another object of the present invention to provide a golf ball having a flight distance longer than that of the conventional golf ball.

Having made energetic researches, the present inventors discovered that in particular, the depth of a dimple has a great influence on aerodynamic characteristic of the golf ball. Based on the result of the research, the depth of each of one group dimples is differentiated from that of each of the other group dimples to make air in the periphery of the golf ball turbulent during the flight thereof. This construction allows the difference between the flight distance of the golf ball in seam hitting and the flight distance thereof in pole hitting to be much reduced compared with that of the conventional golf ball, and further, allows the golf ball to have a flight distance longer than that the conventional golf ball.

That is, in one aspect of the present invention, the golf ball according to the present invention has a plurality of dimples formed on the surface thereof and only one great circle path unintersecting with the dimples formed on the surface thereof. The dimples have the same diameter. The dimples comprise first group dimples having a larger depth and second group dimples having a smaller depth. The first group dimples have the same depth and the second group dimples have the same depth. The depth of each of the first group dimples is from 130% to 280% of that of each of the second group dimples. The number of the first group dimples is from 20% to 80% of the total number of the dimples. The number of the second group dimples is from 80% to 20% of the total number of the dimples.

In another aspect of the present invention, a golf ball according to the present invention has a plurality of dimples formed on the surface thereof and only one great circle path unintersecting with the dimples formed on the surface thereof. The dimples are classified into a plurality different kinds according to diameters. The dimples of each kind comprises first group dimples having a larger depth and second group dimples having a smaller depth. The first and second group dimples of each kind have the same depth, respectively. The depth of each of the first group dimples of each kind is from 130% to 280% of that of each of the second group dimples thereof. The number of the first group dimples of each kind is from 20% to 80% of the total number of the dimples thereof. The number of the second group dimples of each kind is about from 80% to 20% of the total number of the dimples thereof.

It is preferable to set the diameter of the dimple to a range of 1.5 mm–5.0 mm both in the case of the golf ball having the dimples of the same diameter and the golf ball, which will be described later, having a plurality of kinds of dimples classified according to diameters.

Referring to FIG. 7, the diameter of the dimple is the distance between contact points A and B of a common tangent (L) at the right and left outer peripheral edges of the carved surface of a dimple 2.

The diameter of the dimple is the range of 1.5 mm– 5.0 mm for the reason described below. If the diameter of the dimple is less than 1.5 mm, mud enters the dimple, thus making the volume thereof too small. Consequently, the function of the dimple deteriorates, whereas if the diameter of the dimple is more than 5.0 mm, the spherical configuration of the golf ball changes to a polygonal configuration. Consequently, it may occur that the patted golf ball does not roll straight.

Preferably, dimples are classified into two to five different kinds according to diameters.

In the golf ball which has been described and will be described later, the depth of the first group dimples having the larger depth is 0.08 mm–0.22 mm and from 130% to 280% of that of the second group dimples.

Referring to FIG. 7, the depth of the dimple is the length of the perpendicular from the mid point of the tangent (L) to the deepest point of the dimple 2, namely, the distance between points C and D.

The depth of the first group dimples is 0.08 mm– 0.22 mm for the reason described below. If the depth is smaller than 0.08 mm, thus, the volume of the dimple is too small, the golf ball is likely to fly in too high trajectory, whereas if the depth thereof is greater than 0.22 mm, thus, the volume of the dimple is too great, the golf ball is likely to fly in too low of a trajectory.

The depth of the first group dimple is from 130% to 280% of that of the second group dimple for the reason described below. If the depth of the first group dimple is smaller than 130% of that of the second group dimple, it is difficult to make air in the periphery of the golf ball turbulent greatly, whereas if the depth of the first group dimple is greater than 280% of that of the second group dimple, the air in the periphery of the golf ball is made to be turbulent to a very great extent. As a result, the golf ball flies in too high of a trajectory.

The volume of the dimple is the volume of an area surrounded with the tangent (L) and the inner peripheral surface of the recess, namely, the portion shown by oblique lines in FIG. 7. The total volume of one golf ball is the sum of the volumes of all dimples formed thereon. The total volume of all the dimples is 250 $mm^3$–450 $mm^3$.

If the total volume of all the dimples is less than 250 $mm^3$, the golf ball is likely to fly in too high of a trajectory whereas if the total volume of all dimples is more than 450 $mm^3$, the golf ball flies in too low of a trajectory.

The golf ball is formed by molding a material in a mold and then, the surface thereof is painted. Thus, even though the diameters and depths of dimples are a given value, respectively, some golf balls have a diameter and a depth slightly different from the given value depending on the thickness of paint.

The diameters and depths of dimples are designed to have a given value, respectively, but some golf balls have a diameter and a depth slightly different from the designed value due the difference in the thickness of paint. In the present invention, such the difference is ignored.

The flight distance of the golf ball can be increased in proportion to the turbulence degree of air flow in the periphery of the golf ball. To this end, a plurality of groups of dimples is formed by differentiating the depths of the dimple groups from each other.

Having conducted experiments, the present inventors have found that air in the periphery of the golf ball can be allowed to be turbulent and the flight distance of the golf ball can be increased by forming two groups of dimples in such a manner that the depth of each of one group dimples is be greater than that of each of the other group dimples by more than 130%.

In addition, the number of the first group dimples is from 20% to 80% of the total number of the dimples, and number of the second group dimples having a smaller depth than that of the first group dimple is 80%–20% of total number of the dimples. This construction allows air to be turbulent even though a great circle path unintersecting with dimples is present on the seam line, thus reducing the difference between the flight distance of the golf ball and the trajectory thereof in seam hitting and those in pole hitting.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
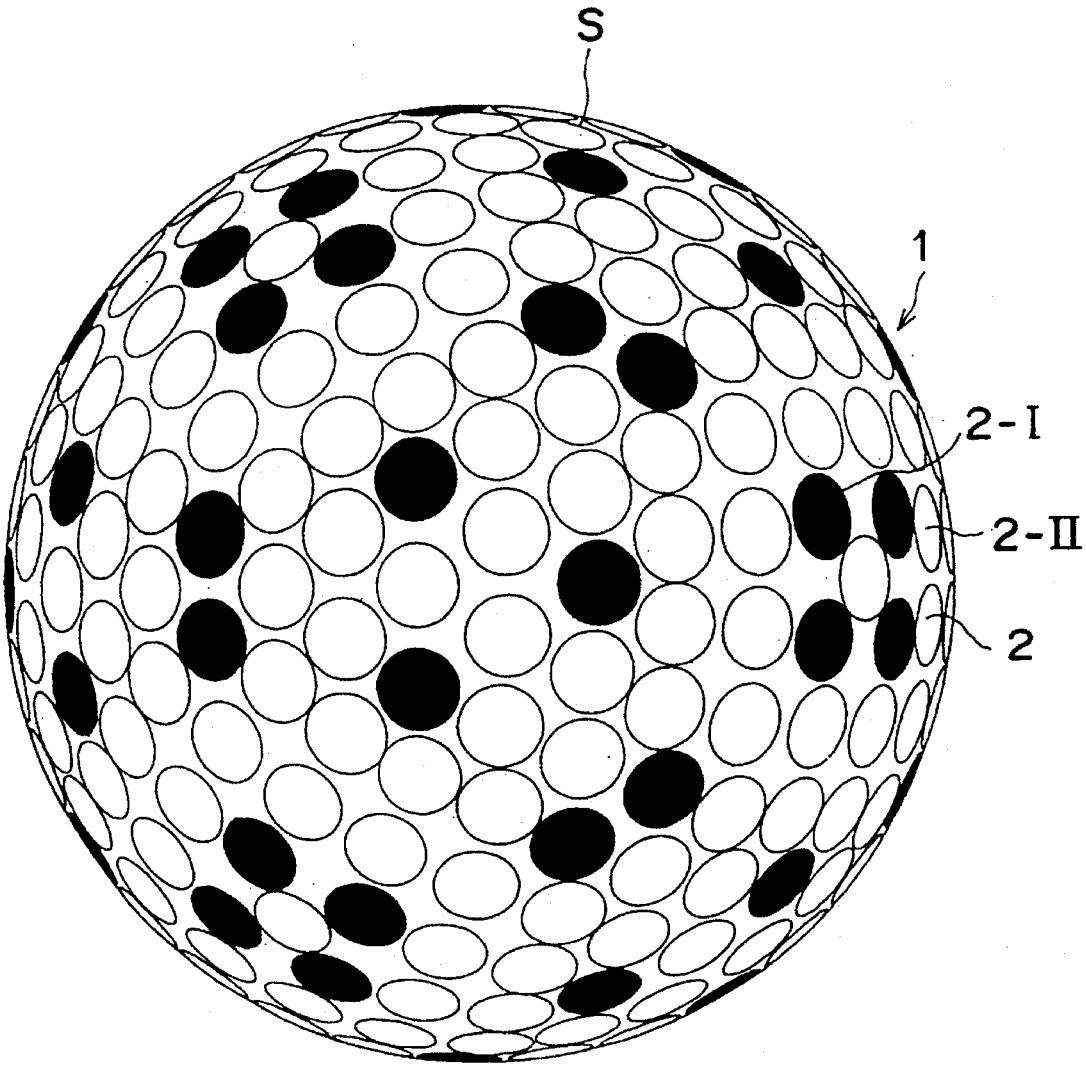
FIG. 1 is a plan view showing a golf ball according to a first embodiment of the present invention.

Before the description of the present invention proceeds, it is to be noted that like parts are designated by like reference numerals throughout the accompanying drawings.

Golf balls according to the embodiments of the present invention is described below with reference to the drawings.

The specifications of dimples according to first through third embodiments of the present invention are as shown in Table 1.

Figure 9A:
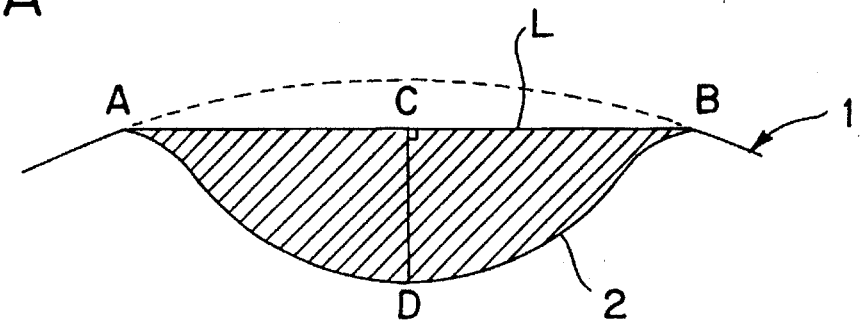
FIGS. 9A and 9B show a representative comparison of dimple 2-I and dimple 2-II, respectively, of the first embodiment.
Figure 9B:
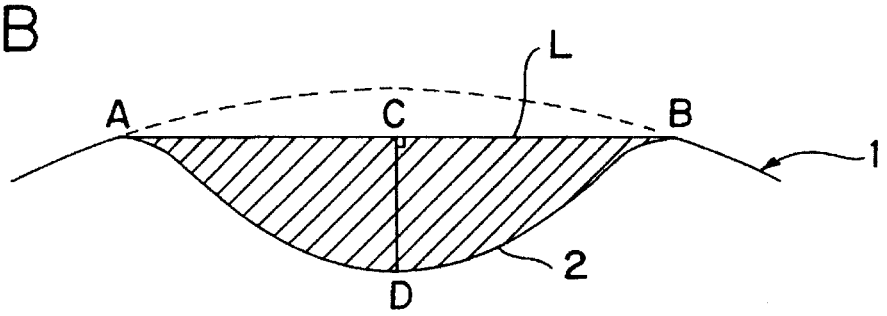
Figure 10A:
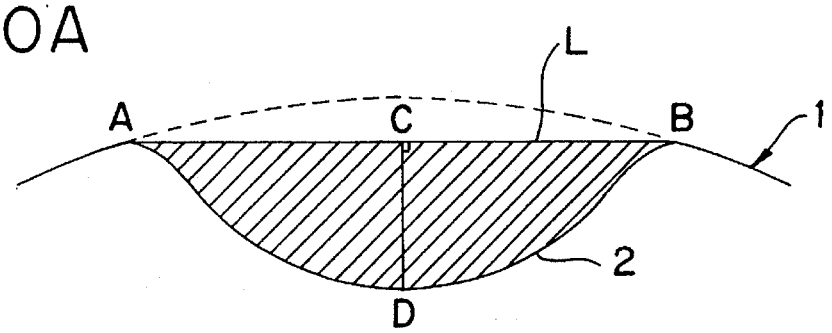
FIGS. 10A, 10B, 10C, and 10D show a representative comparison of dimples 2A-I 2A-II, 2B-I and 2B-II, respectively, of the second and third embodiments.
Figure 10B:
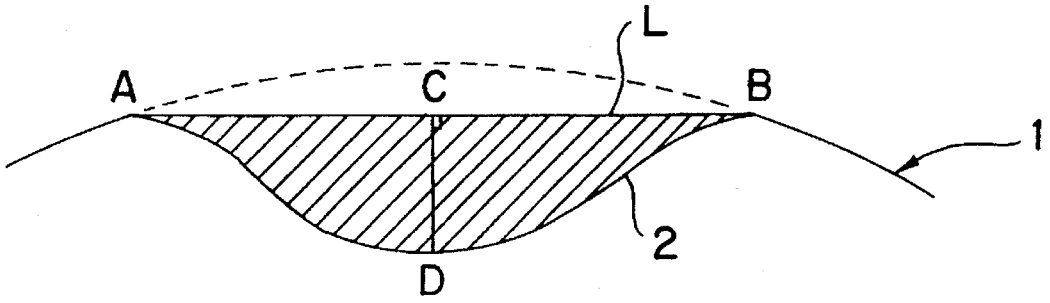
Figure 10C:
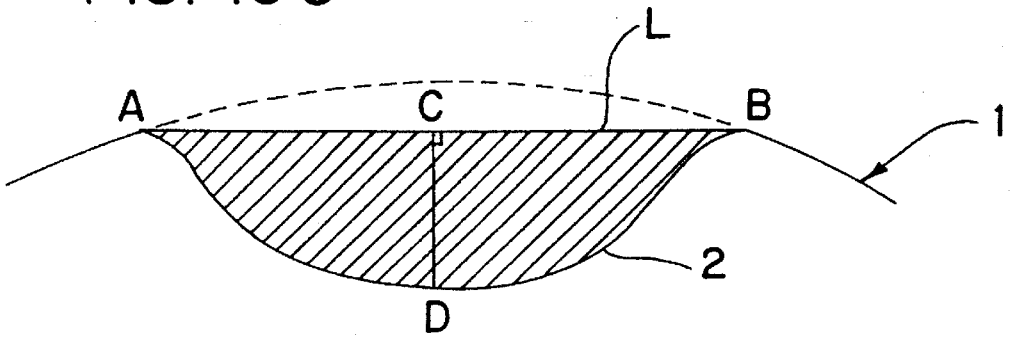
Figure 10D:
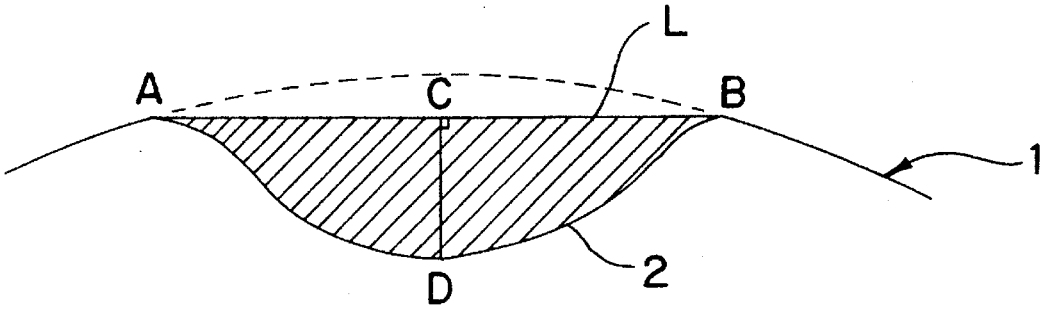

Table 1 shows the specifications of golf balls according to first through fourth comparison examples in addition to the golf balls according to the first through third embodiments.

latter about 130%. An illustration of these dimples is shown in FIGS. 9A and 9B.

The depths of all the first group dimples 2-I are the same, namely, 0.1672 mm and those of all the second group dimples 2-II are also the same, namely, 0.1286 mm.

The number of the first group dimples 2-I is 72. In the first embodiment, the total number of the dimples 2 is 342. According to the present invention, the number of the first group dimples 2-I is from 20% to 80% of the total number of the dimples 2. In the first embodiment, the number of the former is about 21% of the total number of the dimples 2. Therefore, the number of the second group dimples 2-II is about 79% of the total number of the dimples 2.

TABLE 1

DIMPLE SPECIFICATION OF EMBODIMENT & COMPARISON EXAMPLE

| | Kind | Group | Number | Total number | Diameter (mm) | Depth (mm) | Volume ($mm^3$) | Total volume ($mm^3$) |
|---|---|---|---|---|---|---|---|---|
| 1st embod. | A | 1 | 72 | 342 | 3.800 | 0.1672 | 1.133 | 310 |
| | | 2 | 270 | | 3.800 | 0.1286 | 0.847 | |
| 1st compar. | A | 1 | 30 | 342 | 3.800 | 0.1732 | 1.177 | 310 |
| | | 2 | 312 | | 3.800 | 0.1332 | 0.881 | |
| 2nd compar. | A | 1 | 72 | 342 | 3.800 | 0.1473 | 0.986 | 310 |
| | | 2 | 270 | | 3.800 | 0.1339 | 0.886 | |
| 2nd embod. | A | 1 | 30 | 342 | 4.000 | 0.1633 | 1.211 | 310 |
| | | 2 | 114 | | 4.000 | 0.1256 | 0.901 | |
| | B | 1 | 42 | | 3.750 | 0.1633 | 1.078 | |
| | | 2 | 156 | | 3.750 | 0.1256 | 0.805 | |
| 3rd embod. | A | 1 | 84 | 342 | 4.000 | 0.1826 | 1.369 | 310 |
| | | 2 | 60 | | 4.000 | 0.0913 | 0.617 | |
| | B | 1 | 72 | | 3.750 | 0.1826 | 1.217 | |
| | | 2 | 126 | | 3.750 | 0.0913 | 0.558 | |
| 3rd compar. | A | 1 | 18 | 342 | 4.000 | 0.1651 | 1.225 | 310 |
| | | 2 | 126 | | 4.000 | 0.1270 | 0.912 | |
| | B | 1 | 42 | | 3.750 | 0.1651 | 1.091 | |
| | | 2 | 156 | | 3.750 | 0.1270 | 0.815 | |
| 4th compar. | A | 1 | 30 | 342 | 4.000 | 0.1409 | 1.027 | 310 |
| | | 2 | 114 | | 4.000 | 0.1281 | 0.921 | |
| | B | 1 | 42 | | 3.750 | 0.1668 | 1.103 | |
| | | 2 | 156 | | 3.750 | 0.1281 | 0.824 | |

Figure 8:
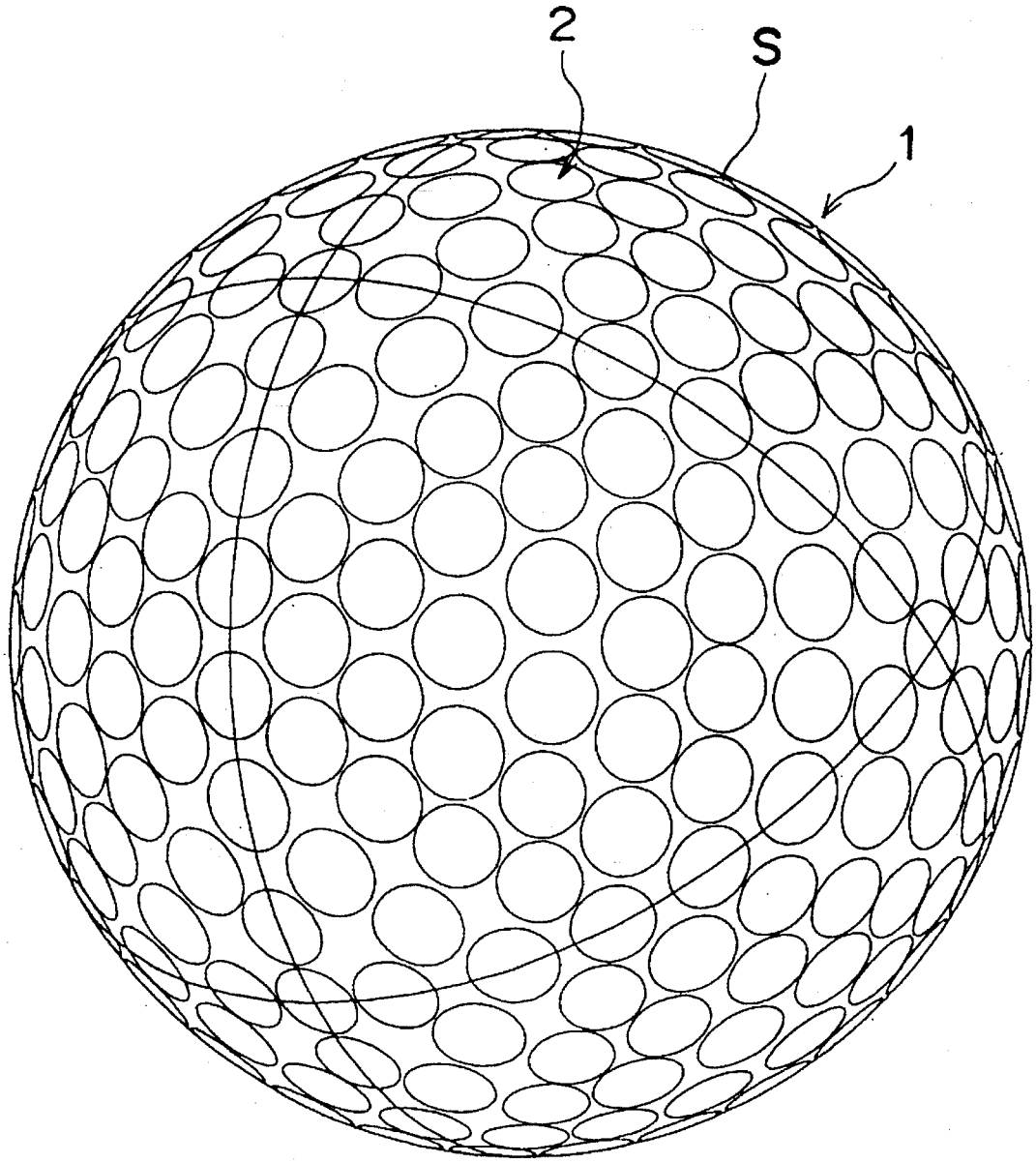
FIG. 8 is a view showing a dimple arrangement in golf balls according to the present invention and comparison examples.

The golf balls according to the embodiments of the present invention and those according to the comparison examples have only one great circle path unintersecting with dimples 2 on a seam line (S). The total number of the dimples 2 is 342. The dimples 2 are arranged on the golf balls in correspondence to the octahedral dimple arrangement shown in FIG. 8.

Although the diameters and depths of the dimples 2 are varied, the total volume thereof is 310 $mm^3$.

The outer configuration of the golf ball according to the first embodiment is as shown in FIG. 1. The diameters of the dimples 2 are all 3.800 mm.

FIGS. 1 through 5 are plan views showing golf balls according to the embodiments and comparison examples with poles disposed at vertexes thereof. Thus, in FIGS. 1 through 5, a great circle path not intersecting with the dimple 2 is disposed along a peripheral line of each golf ball in FIGS. 1 through 5.

Figure 2:
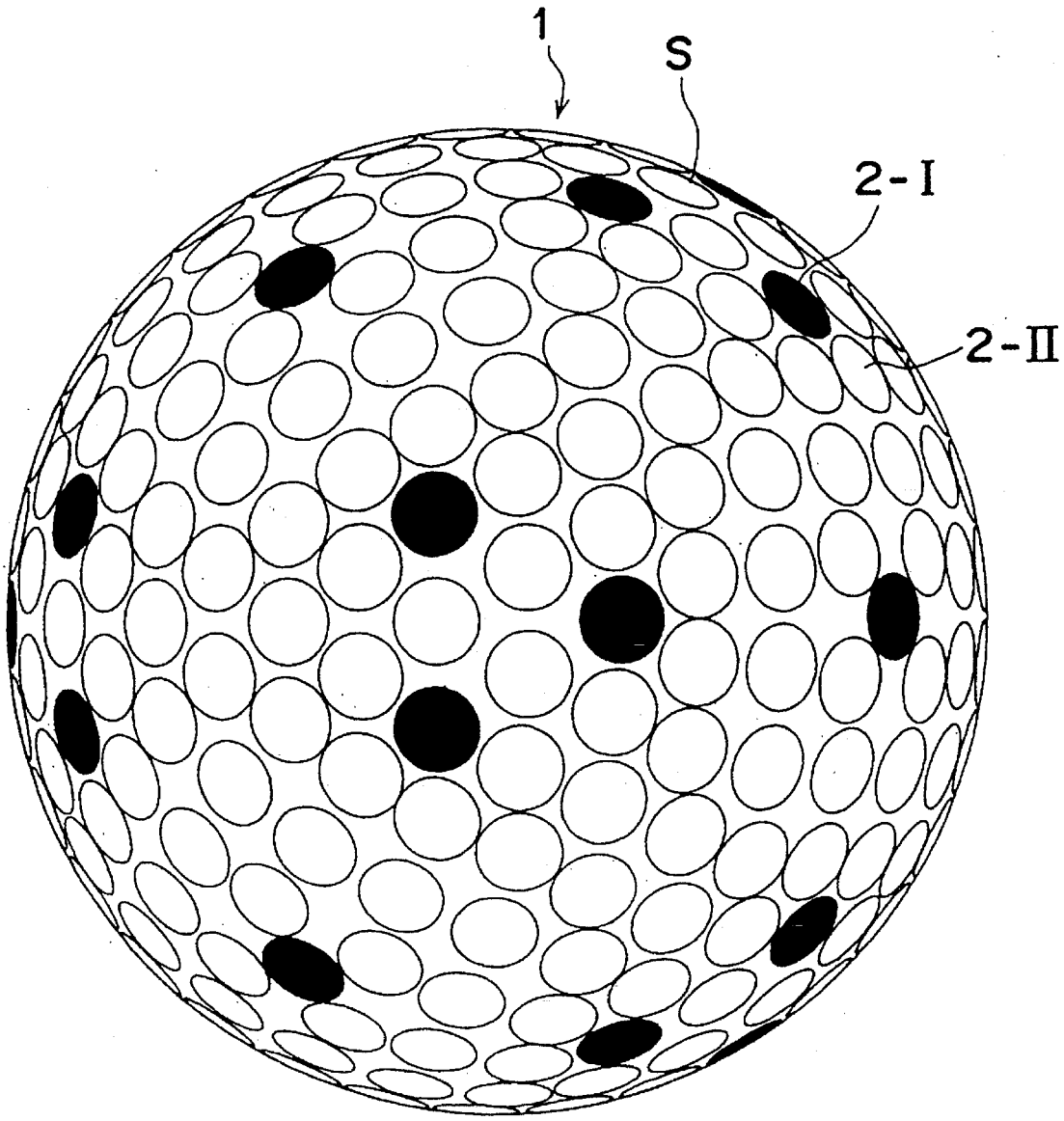
FIG. 2 is a plan view showing a golf ball according to a first comparison example.

The dimple 2 according to the first embodiment comprises a first group dimple 2-I (painted in black in FIG. 1) having a larger depth of 0.1672 mm and a second group dimple 2-II having a smaller depth of 0.1286 mm. According to the present invention, the depth of the first group dimple 2-I is from 130% to 280% of that of the second group dimple 2-II. In the first embodiment, the depth of the former to that of the The outer configuration of the golf ball according to the first comparison example is as shown in FIG. 2. The dimple of the golf ball according to the first comparison example is similar to that of the golf ball according to the first embodiment in that the diameters of the dimples of the golf ball according to the first comparison example are identical to each other, namely, 3.800 mm and that the depth of the first group dimple is about 130% of that of the second group dimple having a smaller depth, except that the number of the first group dimples is about 9% of the total number of the dimples of the golf ball according to the first comparison example. Thus, the golf ball according to the first comparison example is excluded from the scope of the present invention.

The outer configuration of the golf ball according to the second comparison example is as shown in FIG. 1, and is similar to that of the golf ball according to the first embodiment in that the diameters of the dimples of the first comparison example are identical to each other, namely, 3.800 mm and that the number of the first group dimples having a larger depth than that of the second group dimples is about 21% of the total number of the dimples of the golf ball according to the second comparison example, except that the depth of the first group dimple is about 117% of that of the second group dimple. Thus, the golf ball according to the second comparison example is excluded from the scope of the present invention.

In the golf ball according to the second and third embodiments and the third and fourth comparison examples, dimples 2 are classified into two kinds, namely, dimples 2A of kind (A) having a larger diameter 4.000 mm and dimples 2B of kind (B) having a smaller diameter 3.750 mm.

The dimple 2A of kind (A) comprises first group dimples 2A-I having a larger depth and second group dimples 2A-II having a smaller depth. Similarly, the dimple 2B of kind (B) comprises first group dimples 2B-I having a larger depth and second group dimples 2B-II having a smaller depth. That is, four kinds of dimples are formed on the surface of the golf ball according to the second and third embodiments and the third and fourth comparison examples.

Figure 3:
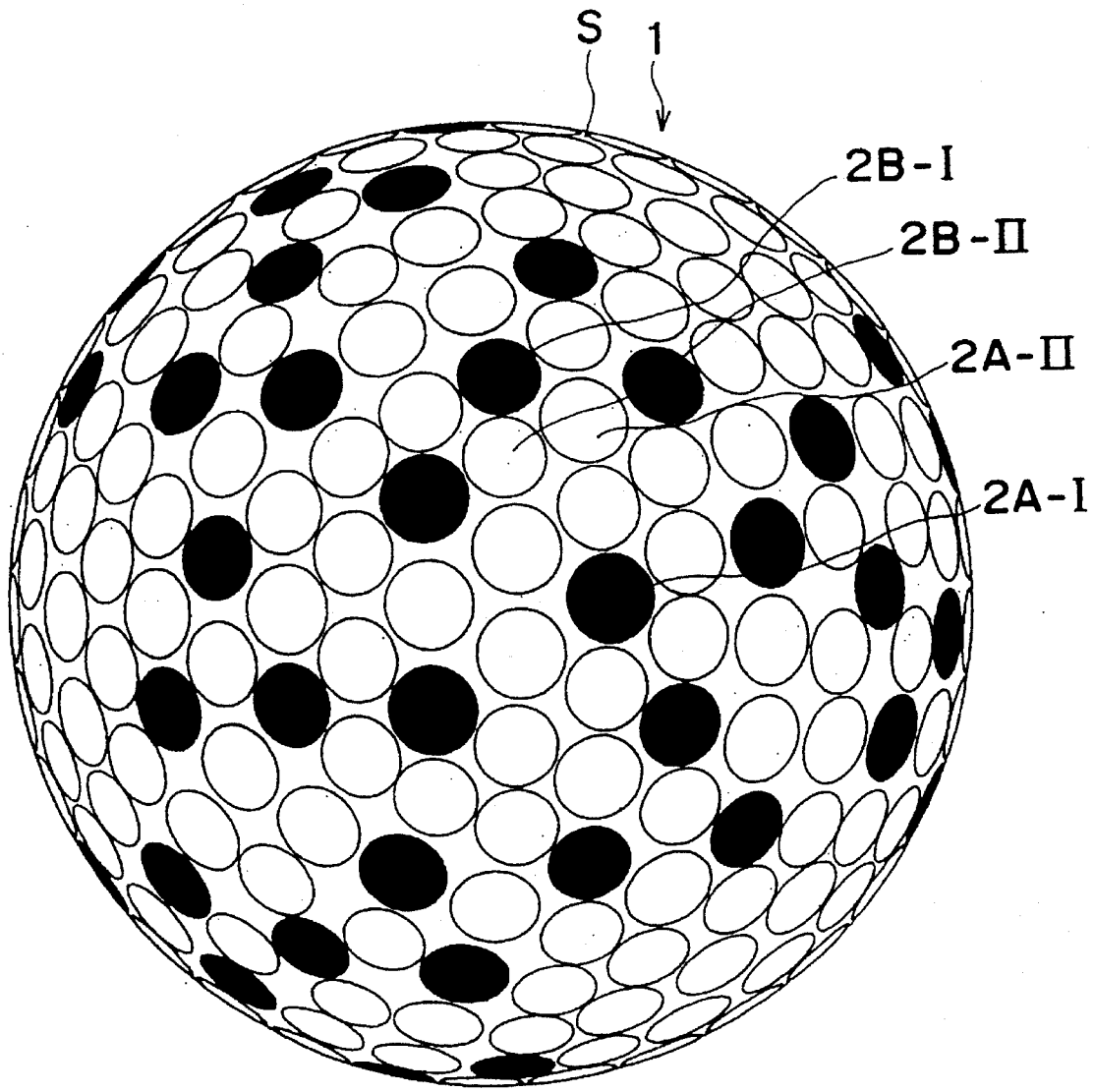
FIG. 3 is a plan view showing a golf ball according to a second embodiment of the present invention.

The outer configuration of the golf according to the second embodiment is as shown in FIG. 3. The number of the first group dimples 2A-I of kind (A) is approximately 21% of the total number of the dimples 2A of kind (A). Similarly, the number of the first group dimples 2B-I of kind (B) is approximately 21% of the total number of the dimples 2B of kind (B).

In the dimple 2A of kind (A), the depth of each of the first group dimples 2A-I is approximately 130% of that of each of the second group dimples 2A-II. Similarly, in the dimple 2B of kind (B), the depth of each of the first group dimples 2B-I is approximately 130% of that of each of the second group dimples 2B-II.

Figure 4:
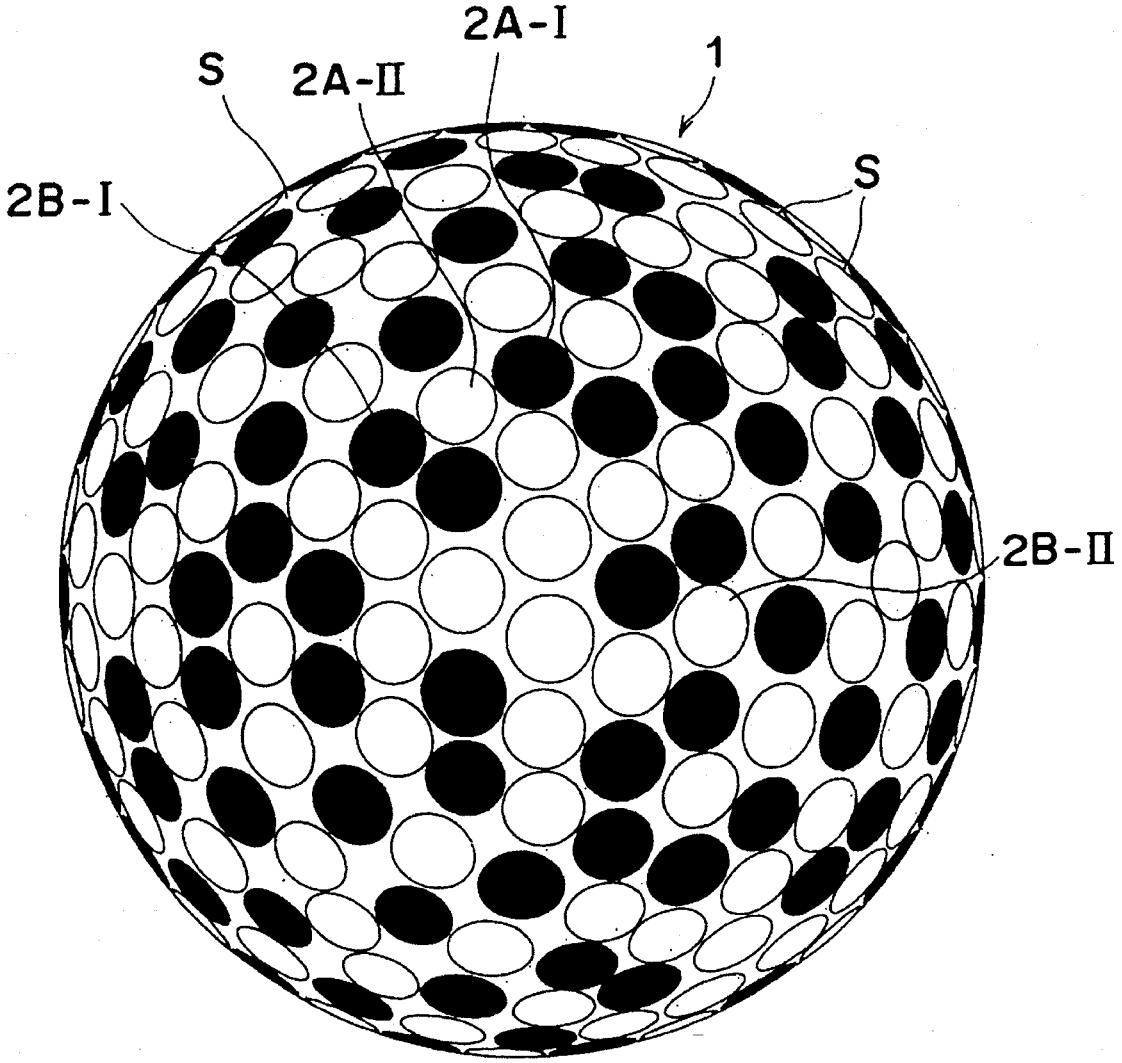
FIG. 4 is a plan view showing a golf ball according to a third embodiment of the present invention.

The outer configuration of the golf according to the third embodiment is as shown in FIG. 4. The number of the first group dimples 2A-I of kind (A) is approximately 58% of the total number of the dimples 2A of kind (A), whereas the number of the first group dimples 2B-I of kind (B) is approximately 36% of the total number of the dimples 2B of kind (B).

In the dimple 2A of kind (A), the depth of the first group dimples 2A-I is approximately 200% of that of the second group dimples 2A-II. Similarly, in the dimple 2B of kind (B), the depth of the first group dimples 2B-I is approximately 200% of that of the second group dimples 2B-II. An illustration of these dimples is shown in FIGS. 10A, 10B, 10C, and 10D.

Figure 5:
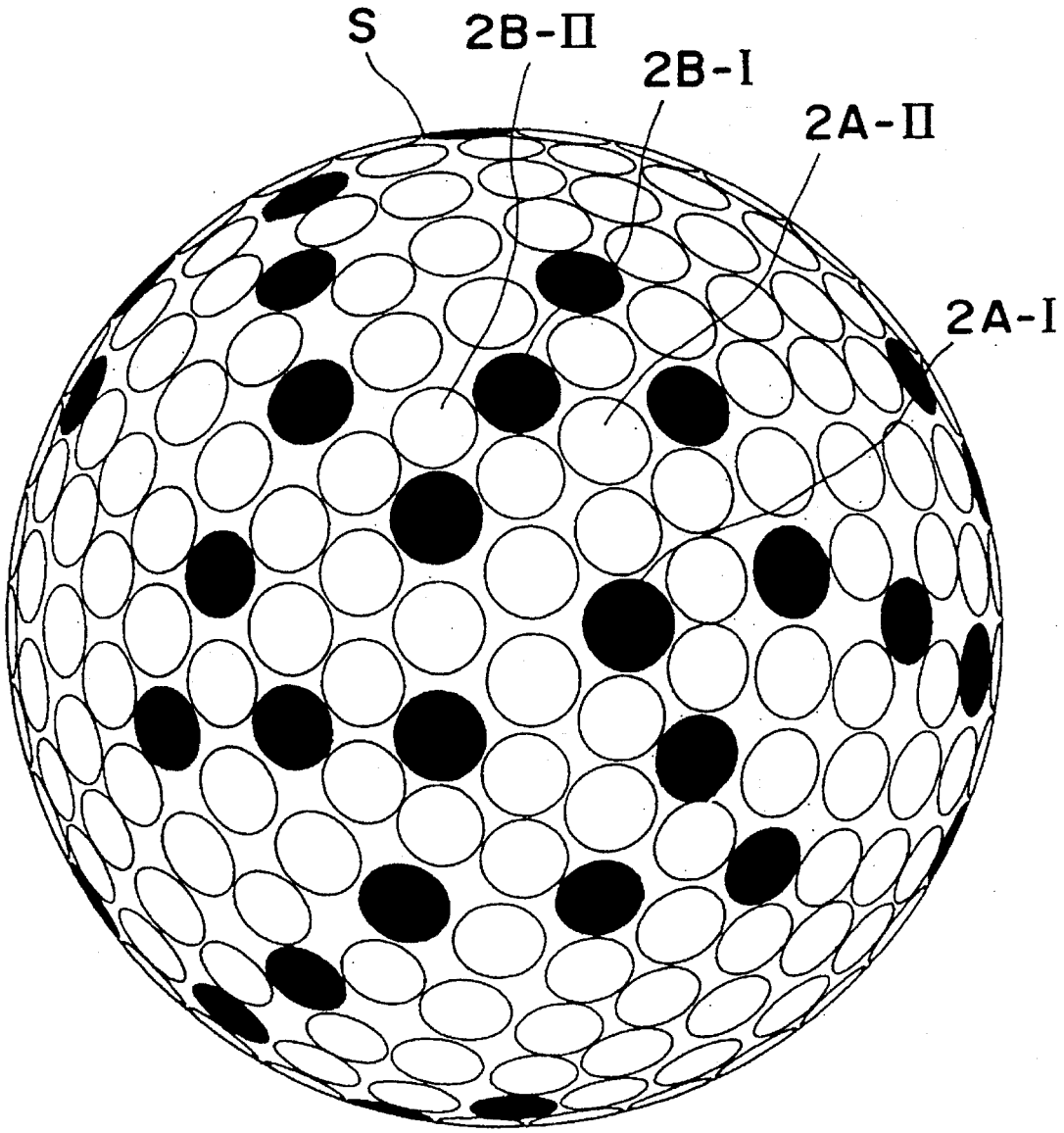
FIG. 5 is a plan view showing a golf ball according to a fourth comparison example.
Figure 6A:
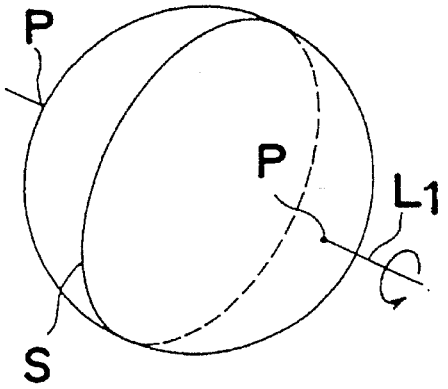
FIG. 6A is a schematic view for describing seam hitting.
Figure 6B:
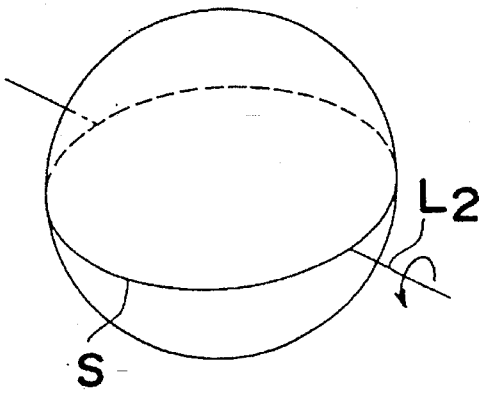
FIG. 6B is a schematic view for describing pole hitting.
Figure 7:
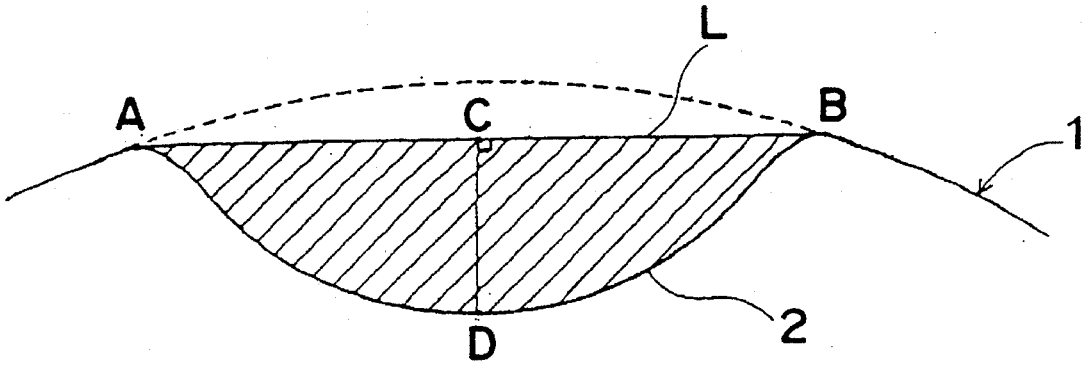
FIG. 7 is a schematic view for describing the diameter and depth of a dimple.

The outer configuration of the golf according to the third comparison example is as shown in FIG. 5. The number of the first group dimples 2A-I of kind (A) is approximately 13% of the total number of the dimples 2A of kind (A). Thus, the golf ball according to the third comparison example is excluded from the scope of the present invention. The number of the first group dimples 2B-I of kind (B) is approximately 21% of the total number of the dimples 2B of kind (B), thus, the number of dimple is included in the scope of the present invention. In the dimples 2A and 2B of each of kind (A) and (B), the depth of the first group dimples is approximately 130% of that of the second group dimples, thus, the depth is included in the scope of the present invention.

The outer configuration of the golf ball according to the fourth comparison example is as shown in FIG. 3 and identical to that of the golf ball according to the second embodiment. Similarly to the golf ball according to the second embodiment, the number of the first group dimples 2A-I of kind (A) is approximately 21% of the total number of the dimples 2A of kind (A). Similarly, the number of the first group dimples 2B-I of kind (B) is approximately 21% of the total number of the dimples 2B of kind (B).

In the dimple 2A of kind (A), the depth of the first group dimples 2A-I is approximately 110% of that of the second group dimples 2A-II. Thus, the golf ball according to the fourth comparison example is excluded from the scope of the present invention.

In the dimple 2B of kind (B), the depth of the first group dimples 2B-I is approximately 130% of that of the second group dimples 2B-II.

In the golf balls according to the first through third embodiments and the first through fourth comparison examples, a cover is mounted on a core having a diameter of about 38.4 mm in such a manner that the outer diameter of the golf ball is 42.75±0.05 mm. That is, the golf balls are of a double construction type, i.e., they are two-piece balls. Compression is 95±3.

In manufacturing the above two-piece golf balls, materials are kneaded by an internal mixer in accordance with a mixing ratio shown in Table 2 to prepare a cylindrical plug. The prepared plug is put into a pressurizing and heating mold die to vulcanize the plug at 150° for 40 minutes so as to form the core having 38.4 mm in diameter. The core is covered with mixture of Surlyn 1707 (manufactured by Mitsui Dupon Polychemical Co., Ltd.) and titanium oxide at a mixing ratio of 100:2. The mixture is mounted on the core by injection molding to obtain the golf ball with an outer diameter of 42.75. Then, a burr generated on the seam line is removed from the golf ball and the surface thereof is then painted.

TABLE 2

| Material | Weight(%) |
|---|---|
| Polybutadiene | 100 |
| Acrylic zinc | 34 |
| Zimic oxide | 17 |
| Dicumyl peroxide | 1.0 |

The following experiments were conducted to compare the flight distance and aerodynamic symmetrical property of the golf balls according to the first through third embodiments with those of the golf balls according to the first through fourth comparison examples.

EXAMPLE OF EXPERIMENT

As shown in Table 1, seven kinds of golf balls according to the first through third embodiments and the first through fourth comparison examples were prepared to conduct experiments.

In the experiments, all golf balls shown in Table 1 were hit at a head speed of 48 m/s by using a swing robot (manufactured by True Temper Corp.) as a driver (wood #1). Wind was against the golf ball and as slow as 0.2 to 0.5 m/s.

Of 48 golf balls prepared for each of the golf balls according to the first through third embodiments and the first through fourth comparison examples, 24 golf balls were pole hitting and 24 golf balls were seam hitting.

Carry, flight time, and angle of elevation of trajectory were measured for each golf ball.

Carry means a distance from a hitting point to a falling point. Flight time means a period of time required from hitting a ball to dropping the ball on the land. Angle of elevation of trajectory means an angle of elevation formed between the highest point in trajectory and a horizontal line. When the angle of elevation of trajectory is great, it can be said that a golf ball has a high trajectory.

Table 3 shows the result of the experiment.

TABLE 3

| | | Carry (yds) | Flight time (sec) | Angle of elevation(°) |
|---|---|---|---|---|
| E1 | Pole hitting | 263.8 | 6.13 | 14.28 |
| | Seam hitting | 264.2 | 6.18 | 14.25 |
| | Difference (Pole-Seam) | −0.4 | −0.05 | 0.03 |
| C1 | Pole hitting | 261.5 | 6.03 | 14.29 |
| | Seam hitting | 264.1 | 6.18 | 14.03 |
| | Difference (Pole-Seam) | −2.6 | −0.15 | 0.26 |
| C2 | Pole hitting | 260.6 | 6.04 | 14.26 |
| | Seam hitting | 261.0 | 6.10 | 14.02 |
| | Difference (Pole-Seam) | −0.4 | −0.06 | 0.04 |
| E2 | Pole hitting | 264.5 | 6.17 | 14.36 |
| | Seam hitting | 264.9 | 6.23 | 14.29 |
| | Difference (Pole-Seam) | −0.4 | −0.06 | 0.07 |
| E3 | Pole hitting | 265.7 | 6.26 | 14.47 |
| | Seam hitting | 265.9 | 6.29 | 14.45 |
| | Difference (Pole-Seam) | −0.2 | −0.03 | 0.02 |
| C3 | Pole hitting | 261.3 | 6.09 | 14.33 |
| | Seam hitting | 263.6 | 6.18 | 14.15 |
| | Difference (Pole-Seam) | −2.3 | −0.09 | 0.18 |
| C4 | Pole hitting | 261.2 | 6.04 | 14.22 |
| | Seam hitting | 261.7 | 6.10 | 14.14 |
| | Difference (Pole-Seam) | −0.5 | −0.06 | 0.08 |

The following points are apparent from the experimental result shown in Table 3.

(1) The diameters of the dimples of the golf balls according to the first embodiment, the first comparison example, and the second comparison example are identical to each other.

In the golf ball according to the first embodiment, the number of the first group dimples is about 21% of the total number of dimples, and the depth of the first group dimple is about 130% of that of the second group dimple. In the golf ball according to the first embodiment, the average value of angle of elevation (average value of pole hitting and seam hitting) was as great as 14.265°, and the average value (average value of pole hitting and seam hitting) of the carry was also as great as 264.0 yards. That is, the golf ball according to the first embodiment had a long flight distance. The symmetrical property of the golf ball according to the first embodiment is also favorable. That is, the difference between the carry in seam hitting and that in pole hitting was as small as 0.4 yards; the difference between the flight time in seam hitting and that in pole hitting was as small as 0.05 seconds; and the difference between the angle of elevation in pole hitting and that in seam hitting was as small as 0.03°.

In the golf ball according to the second comparison example, the number of the first group dimples is about 21% of the total number of the dimples, and the depth of the first group dimple is about 117% of that of the second group dimple. The symmetrical property of the golf ball according to the second comparison example is favorable. That is, the difference between the carry in seam hitting and that in pole hitting was as small as 0.4 yards; the difference between the flight time in seam hitting and that in pole hitting was as small as 0.06 seconds; and the difference between the angle of elevation in pole hitting and that in seam hitting was as small as 0.04°. The average value of the angle of elevation was as small as 14.04°, and the average value of the carry was as small as 260.8 yards. That is, the golf ball according to the second comparison example did not have a long flight distance.

In the golf ball according to the first comparison example, similarly to the first embodiment, the depth of the first group dimple is about 130% of that of the second group dimple, whereas the number of the first group dimples is about 9% of the total number of dimples. Thus, the average value (average value of pole hitting and seam hitting) of the carry was comparatively great, namely, 262.8 yards. But the symmetrical property of the golf ball according to the first comparison example was unfavorable because the difference between the carry in seam hitting and that in pole hitting was as great as 2.6 yards; the difference between the flight time in seam hitting and that in pole hitting was as great as 0.15 seconds; and the difference between the angle of elevation in pole hitting and angle of elevation in seam hitting was as great as 0.26°.

In the golf balls according to the second and third embodiments and the third and fourth comparison examples, dimples are classified into two groups (A) and (B) depending on diameter.

In the golf ball according to the second embodiment, the number of the first group dimples 2A-I of kind (A) is approximately 21% of the total number of the dimples of kind (A). Similarly, the number or the first group dimples 2B-I of kind (B) is approximately 21% of the total number of the dimples of kind (B). In the dimple of kind (A) and kind (B), the depth of the first group dimple 2A-I, 2B-I is approximately 130% of that of the second group dimple 2A-II, 2B-II. The average value (average value of pole hitting and seam hitting) of the angle of elevation was as high as 14.325°, and the average value (average value of pole hitting and seam hitting) of the carry was as great as 264.7 yards. The symmetrical property of the golf ball according to the second embodiment was favorable, because the difference between the carry in seam hitting and that in pole hitting was as small as 0.4 yards; the difference between the flight time in seam hitting and that in pole hitting was as small as 0.06 seconds; and the difference between the angle of elevation in pole hitting and that in seam hitting was as small as 0.04°.

In the golf ball according to the third embodiment, the number of the first group dimples 2A-I of kind (A) is approximately 58% of the total number of the dimples of kind (A), whereas the number of the first group dimples 2B-I of kind (B) is approximately 36% of the total number of the dimples of kind (B). In both the dimple of kind (A) and kind (B), the depth of the first group dimple 2A-I, 2B-I is approximately 200% of that of the second group dimple 2A-II, 2B-II. The average value (average value of pole hitting and seam hitting) of the angle of elevation was as great as 14.46°, and the average value (average value of pole hitting and seam hitting) of the carry was 265.8 yards which was greater than any other carry of the golf ball according to the first and second embodiments and the first through the fourth comparison examples. The symmetrical property of the golf ball according to the third embodiment was favorable. That is, the difference between the carry in seam hitting and that in pole hitting was as small as 0.2 yards; the difference between the flight time in seam hitting and that in pole hitting was as small as 0.03 seconds; and the difference between the angle of elevation in pole hitting and that in seam hitting was as small as 0.02°.

In the golf ball according to the fourth comparison example, the number of the first group dimples of kind (A)

is approximately 21% of the total number of the dimples of kind (A). Similarly, the number of the first group dimples of kind (B) is approximately 21% of the total number of the dimples of kind (B). Thus, with respect above point, the golf ball according to the fourth comparison example is included in the scope of the present invention. In the dimple of kind (B), the depth of the first group dimple is approximately 130% of that of the second group dimple, whereas in the dimple of kind (A), the depth of the first group dimples is only approximately 110% of that of the second group dimple. Thus, the golf ball according to the first comparison example is excluded from the scope of the present invention. In the golf ball according to the fourth comparison example, the symmetrical property of the golf ball according to the fourth comparison example was favorable. That is, the difference between the carry in seam hitting and that in pole hitting was as small as 0.5 yards; the difference between the flight time in seam hitting and that in pole hitting was as small as 0.08 seconds; and the difference between the angle of elevation in pole hitting and that in seam hitting was as small as 0.08°. But the average value of the angle of elevation was as small as 14.18 and the average value of the carry was as small as 261.45 yards. That is, the golf ball according to the fourth comparison example did not have a long flight distance.

In the golf according to the third comparison example, the number of the first group dimples of kind (A) is as small as approximately 13% of the total number of the dimples of kind (A). Thus, the golf ball according to the fourth comparison example is excluded from the scope of the present invention. The number of the first group dimples of kind (B) is approximately 21% of the total number of the dimples of kind (B). In the dimples of kind (A) and (B), the depth of the first group dimple is approximately 130% of that of the second group dimple. Thus, with respect to the depth of the dimple, the golf ball according to the third embodiment is included in the scope of the present invention. In the golf according to the third comparison example, although the average distance (average distance of pole hitting and seam hitting) of the carry was as long as 262.45 yards, the symmetrical property of the golf ball according to the third comparison example was not favorable. That is, the difference between the carry in seam hitting and that in pole hitting was as large as 2.3 yards; the difference between the flight time in seam hitting and that in pole hitting was as large as 0.09 seconds; and the difference between the angle of elevation in pole hitting and that in seam hitting was as great as 0.18°.

As apparent from the foregoing description, the dimples of the golf ball according to the present invention are classified into the first group and the second group depending on the depth thereof supposing that the diameters of all the dimples are equal to each other. The dimples according to the present invention make air more turbulent than those of the conventional golf ball, thus allowing the golf ball to have a favorable symmetrical property. That is, even though a great circle path unintersecting with dimples is present on the seam line, the aerodynamic property of the golf ball in seam hitting is not much different from the aerodynamic property thereof in pole hitting.

In the dimples having the same diameter, the depth of the first group dimple is from 130% to 280% of that of the second group dimple. This construction allows makes air in the periphery of the golf ball to be turbulent and hence the flight distance of the golf ball to be increased. Further, the number of the first group dimples from 20% to 80% of the total number of the dimples, thus reducing the difference between the aerodynamic property flight distance of the golf ball in seam hitting and that in pole hitting.

In addition, dimples are classified into many kinds depending on diameter, and each kind of dimple is classified into two groups according to depth. This construction also allows air to be more turbulent than dimples of the conventional golf ball and allows the golf ball to have a long flight distance. In addition, the number of the first group dimples is 20%–80% of the total number of the dimples of each kind of dimple. This construction allows the aerodynamic symmetrical property of the golf ball to be favorable even though the great circle path is present on the seam line.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball having a plurality of dimples formed on the surface thereof and only one great circle path unintersecting with the dimples formed on the surface thereof, wherein: the plurality of dimples comprises a first group of dimples and a second group of dimples, the dimples of both the first group dimples and second group dimples have substantially the same diameter;

the dimples of the first group dimples have a larger depth than the depth of the second group dimples;

each of the first group dimples have substantially the same depth and each of the second group dimples have substantially the same depth;

the depth of each of the first group dimples is from 130% to 280% of the depth of each of the second group dimples;

the number of the first group dimples is from 20% to 80% of the total number of the plurality of dimples; and the number of the second group dimples is from 80% to 20% of the total number of the plurality of dimples.

2. The golf ball according to claim 1, wherein the plurality of dimples totals 342.

3. The golf ball according to claim 1, wherein a total volume of the plurality of dimples is in a range of 250 $mm^3$ to 450 $mm^3$.

4. A golf ball having a plurality of dimples formed on the surface thereof and only one great circle path unintersecting with the dimples formed on the surface thereof, wherein the dimples are classified into a plurality of kinds of dimples, each kind of said plurality of kinds of dimples having substantially the same diameter;

each said kind of dimples includes a first group of dimples and a second group of dimples, said first group having a larger depth than a depth of said second group of dimples;

said first and second groups of dimples of each said kind have substantially the same depth, respectively;

the depth of each of said first group dimples of each said kind is from 130% to 280% of the depth of each of said second group of dimples thereof;

the number of said first group of dimples of each said kind is from 20% to 80% of the total number of the dimples thereof; and the number of said second group of dimples of each said kind is from 80% to 20% of the total number of the dimples thereof.

5. The golf ball according to claim 4, wherein the plurality of dimples totals 342.

6. The golf ball according to claim 4, wherein a total volume of the plurality of dimples is in a range of 250 $mm^3$ to 450 $mm^3$.

* * * * *